US012269563B2

(12) United States Patent
Myers et al.

(10) Patent No.: US 12,269,563 B2
(45) Date of Patent: Apr. 8, 2025

(54) MODULAR PONTOON SEATING ASSEMBLY WITH OPTIMIZED STORAGE

(71) Applicant: Pontoonstuff, Inc., Elkhart, IN (US)

(72) Inventors: James Myers, Miami, FL (US); Jason Begin, Roswell, GA (US); Karl Biewald, Minneapolis, MN (US)

(73) Assignee: PONTOONSTUFF, INC., Elkhart, IN (US)

( * ) Notice: Subject to any disclaimer, the term of this patent is extended or adjusted under 35 U.S.C. 154(b) by 93 days.

(21) Appl. No.: 18/152,325

(22) Filed: Jan. 10, 2023

(65) Prior Publication Data

US 2023/0257078 A1 Aug. 17, 2023

Related U.S. Application Data

(60) Provisional application No. 63/297,904, filed on Jan. 10, 2022.

(51) Int. Cl.
*B63B 29/04* (2006.01)
*A47C 7/62* (2006.01)

(52) U.S. Cl.
CPC ..... *B63B 29/04* (2013.01); *A47C 7/628* (2018.08); *B63B 2029/043* (2013.01)

(58) Field of Classification Search
CPC .... B63B 2029/043; B63B 29/04; A47C 7/628
See application file for complete search history.

(56) References Cited

U.S. PATENT DOCUMENTS

| | | | | |
|---|---|---|---|---|
| 2,349,766 | A * | 5/1944 | Simjian | A47C 7/64 248/188 |
| 2,381,667 | A * | 8/1945 | Jensen | F25C 1/24 62/258 |
| 5,622,404 | A * | 4/1997 | Menne | A47C 7/628 297/188.1 |
| 5,884,795 | A * | 3/1999 | Godbersen | A47C 7/628 297/188.1 |
| 8,616,143 | B2 * | 12/2013 | Hancock, Jr. | B63B 19/12 114/201 R |
| 9,487,273 | B1 * | 11/2016 | Eekhoff | B63B 35/34 |
| 9,688,168 | B2 * | 6/2017 | Gratz | B60N 2/309 |
| 10,569,840 | B2 * | 2/2020 | Langevin | A47C 7/02 |

(Continued)

FOREIGN PATENT DOCUMENTS

CA 3151888 A1 * 7/2019 ..... B63B 13/02

*Primary Examiner* — Timothy J Brindley

(57) ABSTRACT

A modular seating assembly includes a top backrest portion, a seat support structure, and a bottom seating portion. The top backrest portion includes a backrest frame, a first backrest cushion, a backrest gap, and a second backrest cushion. The seat support structure includes a pair of supports connecting the top backrest portion and the bottom seating portion to one another to form the modular seating assembly. The bottom seating portion includes a seat apex section including the second backrest cushion, and a seat base section on which the seat apex section is disposed when the bottom seating portion is in a closed position. The seat apex section is configured to rotate away from the seat base section when the bottom seating portion is in an open position. The modular seating assembly includes a storage region formed within the bottom seating portion of the modular seating assembly.

19 Claims, 6 Drawing Sheets

(56) References Cited

U.S. PATENT DOCUMENTS

| | | | | |
|---|---|---|---|---|
| 2009/0261630 | A1* | 10/2009 | Jurcic | A47B 85/04<br>29/525.01 |
| 2014/0216327 | A1* | 8/2014 | Chen | A47C 4/021<br>114/363 |
| 2019/0300130 | A1* | 10/2019 | Curts | B63B 29/04 |

* cited by examiner

MODULAR PONTOON SEATING ASSEMBLY WITH OPTIMIZED STORAGE

CROSS-REFERENCE TO RELATED APPLICATION

This application claims priority to U.S. Provisional Patent Application 63/297,904, filed in the U.S. Patent and Trademark Office on Jan. 10, 2022, the entire contents of which are herein incorporated by reference.

TECHNICAL FIELD

Embodiments described herein generally relate to seating assemblies, and more particularly to a modular pontoon seating assembly with optimized storage and a method of manufacturing the same.

BACKGROUND

Existing seating assemblies for boats have limited configurability. One contributing factor that limits configurability is that existing assemblies rely on nearby structures, such as railings for support. This limitation prevents the seating structure from being positioned in a freestanding position. Moreover, due to the construction of previous solutions, access openings for storage are limited, and therefore, the types of items that can be stored are also limited because such items cannot fit through the access opening. In the past, these problems have been addressed by assigning a specific location to store larger items, or by not accommodating for such larger items at all. However, these solutions do not provide users with options, and therefore, the larger items were often in the way because such items were stored in the open. In fact, some larger items, such as, for example, gas tanks may be installed improperly or in locations that are not properly vented, thereby creating explosion hazards because of the limited space available to store the gas tanks. Hence, an improved seating assembly for boats is desirable.

This Background section may contain recognitions of one or more problems in the related art that were derived in conjunction with the embodiments presented herein. Accordingly, none of this Background section should be considered as "admitted" in the public domain prior to the effective filing date of this application.

SUMMARY

An aspect of the disclosure is to provide an improved modular pontoon seating assembly and method of manufacturing the same.

According to an embodiment of the disclosure, a modular seating assembly may include a top backrest portion, a seat support structure, and a bottom seating portion. The top backrest portion may include a backrest frame, a first backrest cushion, a backrest gap, and a second backrest cushion. The seat support structure may include a pair of supports connecting the top backrest portion and the bottom seating portion to one another to form the modular seating assembly. The bottom seating portion may include a seat apex section including the second backrest cushion, and a seat base section on which the seat apex section may be disposed when the bottom seating portion is in a closed position. The seat apex section may be configured to rotate away from the seat base section when the bottom seating portion is in an open position. The modular seating assembly may include a storage region formed within the bottom seating portion of the modular seating assembly.

The seat apex section may include a seat, and a bolster flap.

The bolster flap may include a cushion portion constituting the second backrest cushion of the top backrest portion, and a reinforcement structure.

The bolster flap may be rotatably coupled to a rear side of the seat.

The pair of supports may include a pair of brackets.

The pair of brackets may be angled.

The pair of brackets may define an aperture in between the pair of brackets.

Each one of the pair of brackets may be disposed in a perpendicular direction relative to a corresponding end of the backrest frame as to define the aperture in between the pair of brackets.

The apex section may include a seat, and a bolster flap, the bolster flap may include a cushion portion constituting the second backrest cushion of the top backrest portion, and the aperture may be configured to receive the bolster flap.

The seat apex section may further include an extension positioned perpendicular to a front side of the seat.

The bottom seating portion may further include a pair of arm pivot attachments attached to the seat apex section.

The pair of arm pivot attachments may be further attached to the base section so that the seat apex section is configured to rotate away from the seat base section when the bottom seating portion is in the open position, and so that the seat apex section is configured to rotate toward to and rest upon the seat base section when the bottom seating portion is in the closed position.

According to another embodiment, a modular seating assembly may include a top backrest portion, a seat support structure, and a bottom seating portion. The top backrest portion may include a backrest frame, a first backrest cushion, a backrest gap, and a second backrest cushion. The seat support structure may include a pair of supports connecting the top backrest portion and the bottom seating portion to one another to form the modular seating assembly. The bottom seating portion may include a seat apex section that may include a seat, and a bolster flap including a cushion portion constituting the second backrest cushion of the top backrest portion. The bottom seating portion may further include a seat base section on which the seat apex section is disposed when the bottom seating portion is in a closed position. The seat apex section may be configured to rotate away from the seat base section when the bottom seating portion is in an open position. The modular seating assembly may include a storage region formed within the bottom seating portion of the modular seating assembly. The bolster flap may be rotatably coupled to a rear side of the seat via a pair of brackets defining an aperture in between the pair of brackets.

According to another embodiment, a method of manufacturing a modular seating assembly may include forming a top backrest portion, forming a seat support structure, and forming a bottom seating portion. The top backrest portion may be formed to include a backrest frame, a first backrest cushion, a backrest gap, and a second backrest cushion. The seat support structure may be formed to include a pair of supports connecting the top backrest portion and the bottom seating portion to one another to form the modular seating assembly. The bottom seating portion may be formed to include a seat apex section including the second backrest cushion, and a seat base section on which the seat apex section is disposed when the bottom seating portion is in a closed position. The seat apex section may be configured to rotate away from the seat base section when the bottom seating portion is in an open position. The modular seating assembly may be formed to include a storage region formed within the bottom seating portion of the modular seating assembly.

BRIEF DESCRIPTION OF THE DRAWINGS

Elements in the figures have not necessarily been drawn to scale in order to enhance clarity and to improve an understanding of these various elements and embodiments of the disclosure. Furthermore, elements not central to this disclosure may not be depicted in order to provide a clear view of the various embodiments.

The various advantages of the embodiments of the present disclosure will become apparent to one skilled in the art by reading the following specification and appended claims, and by referencing the following drawing(s), in which:

DETAILED DESCRIPTION OF THE EMBODIMENTS

Figure 1:
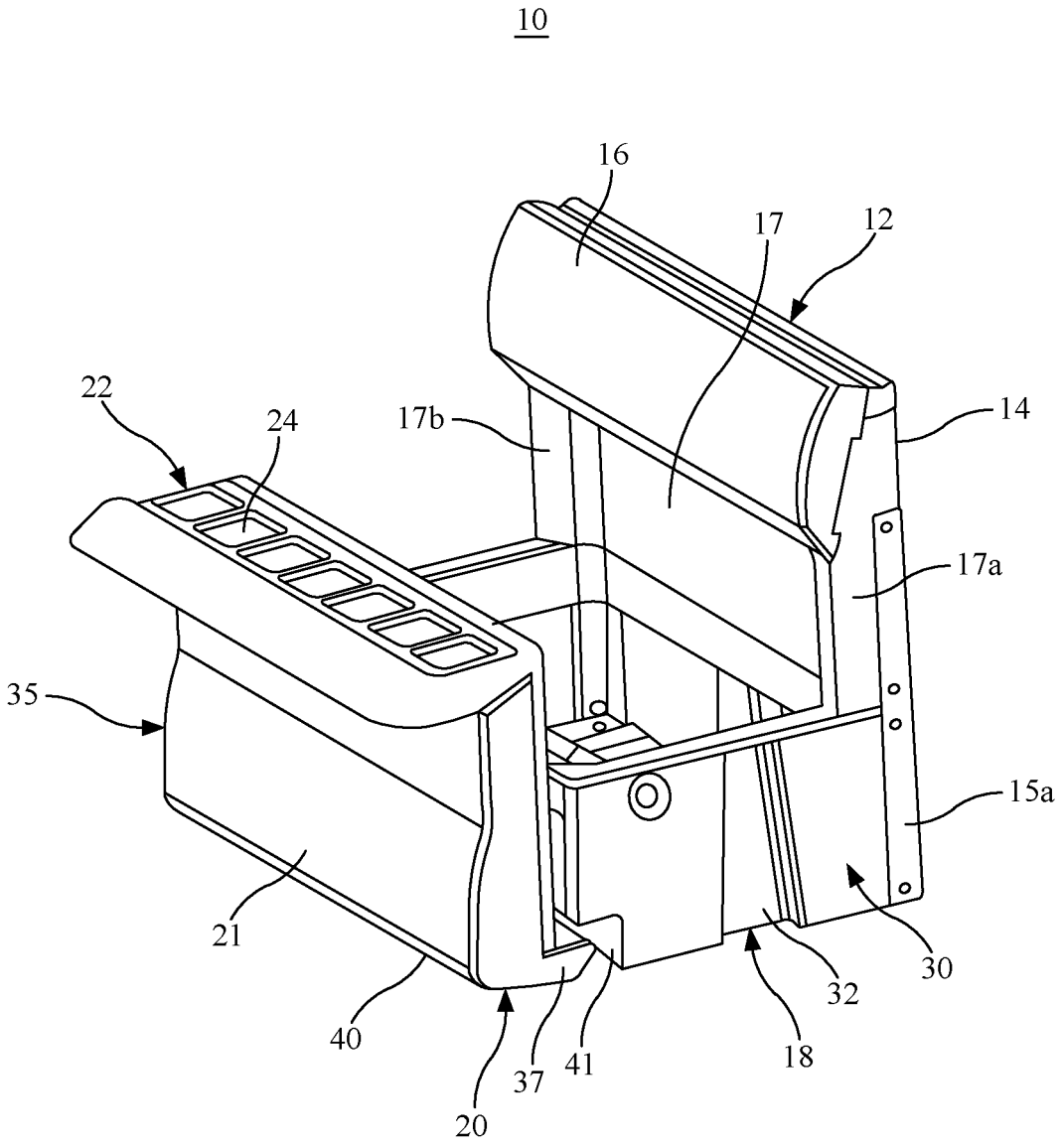
FIG. 1 is a schematic perspective view of a modular seating assembly in an open position according to an embodiment of the present disclosure.

Embodiments will now be described with reference to the accompanying drawings.

The disclosure may be embodied in many different forms and should not be construed as limited to the embodiments set forth herein. It will be apparent to persons skilled in the art that various changes in form and detail can be made to various embodiments without departing from the spirit and scope of the present disclosure. Various embodiments may utilize elements and/or components other than those illustrated in the drawings, and some elements and/or components may not be present in various embodiments. Like reference numerals refer to like elements throughout.

Use of singular forms (e.g., "a", "an", "the") should be interpreted to include plural forms as well (and vice versa), unless the context clearly indicates otherwise.

In the specification and the claims, the term "and/or" is intended to include any combination of the terms "and" and "or" for the purpose of its meaning and interpretation. The terms "and" and "or" may be used in the conjunctive or disjunctive sense and may be understood to be equivalent to "and/or."

The terms "comprises," "comprising," "includes," and/or "including,", "has," "have," and/or "having," and variations thereof when used herein, specify the presence of stated elements, but do not preclude the presence or addition of one or more other elements.

The terms "first," "second," etc., may be used to describe various elements. However, these elements should not be limited by these terms. Rather, such terms are only used to distinguish one element from another element. For example, a "first" element may be referred to as a "second" element without departing from the scope of the disclosure.

In the interest of brevity, elements or operations that are substantially the same as those already described will generally not be fully described again.

It should be understood that when an element is referred to as being "connected" or "coupled" to another element, it can be directly connected or coupled to the other element or intervening elements may be present. In contrast, when an element is referred to as being "directly connected" or "directly coupled" to another element, there may be no intervening elements present. Other words used to describe the relationship between elements should be interpreted in a like fashion (e.g., "between" versus "directly between," "adjacent" versus "directly adjacent," etc.).

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

As noted above, there is a need for an improved seating assembly for boats. The present disclosure describes a modular pontoon seating assembly with optimized storage (also referred to herein as a modular seating assembly). The modular seating assembly provides a storage solution that allows users to configure their boat designs differently (e.g., unique configurations for each boat). Moreover, the storage solution permits the storage of larger items (e.g., gas tanks, coolers, portable refrigerators, and the like). The modular seating assembly may be used in different environments. In an example environment, the modular seating assembly may be configured for pontoon boat use.

Figure 2:
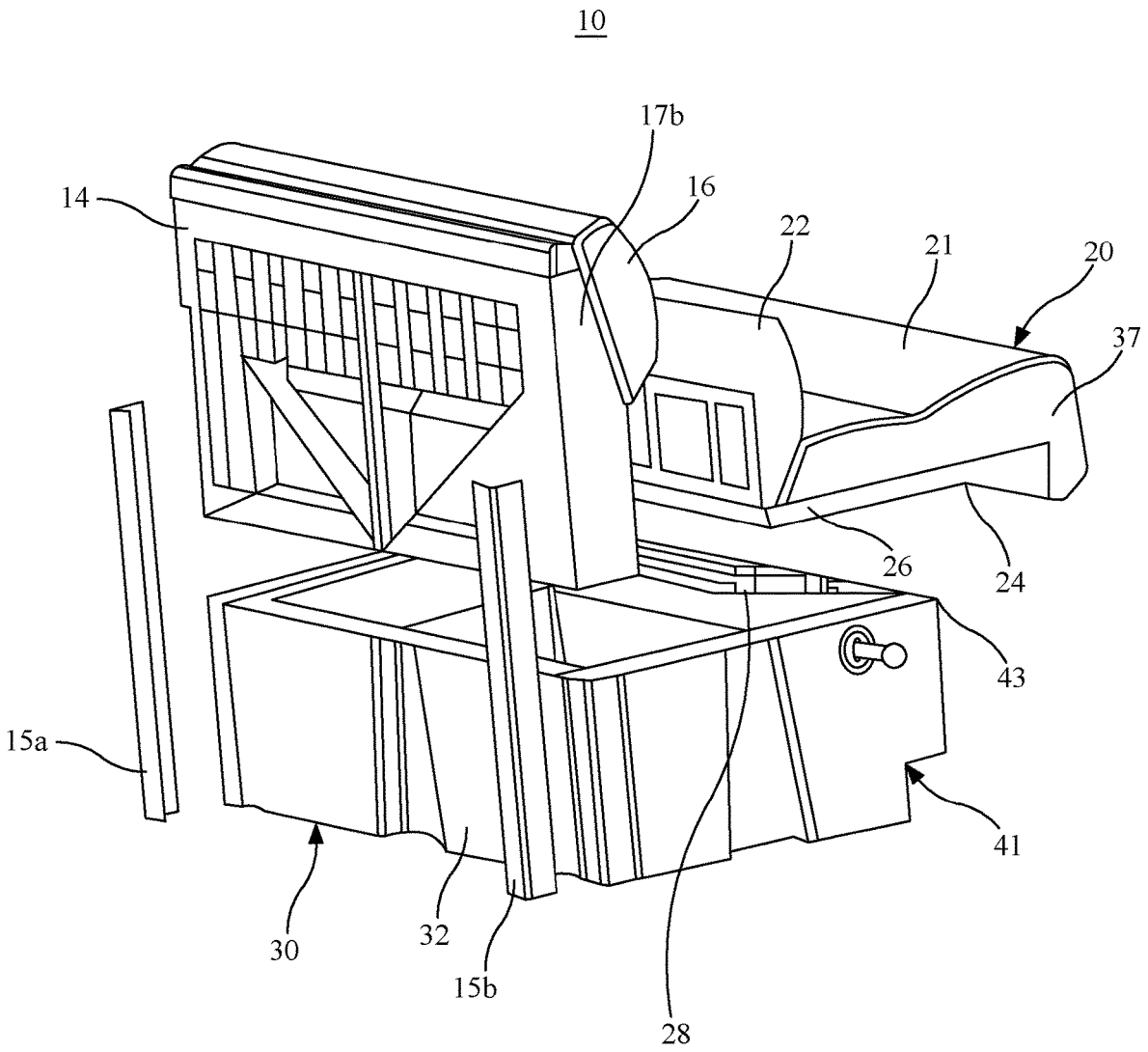
FIG. 2 is a rear schematic exploded perspective view of the modular seating assembly of FIG. 1.
Figure 3:
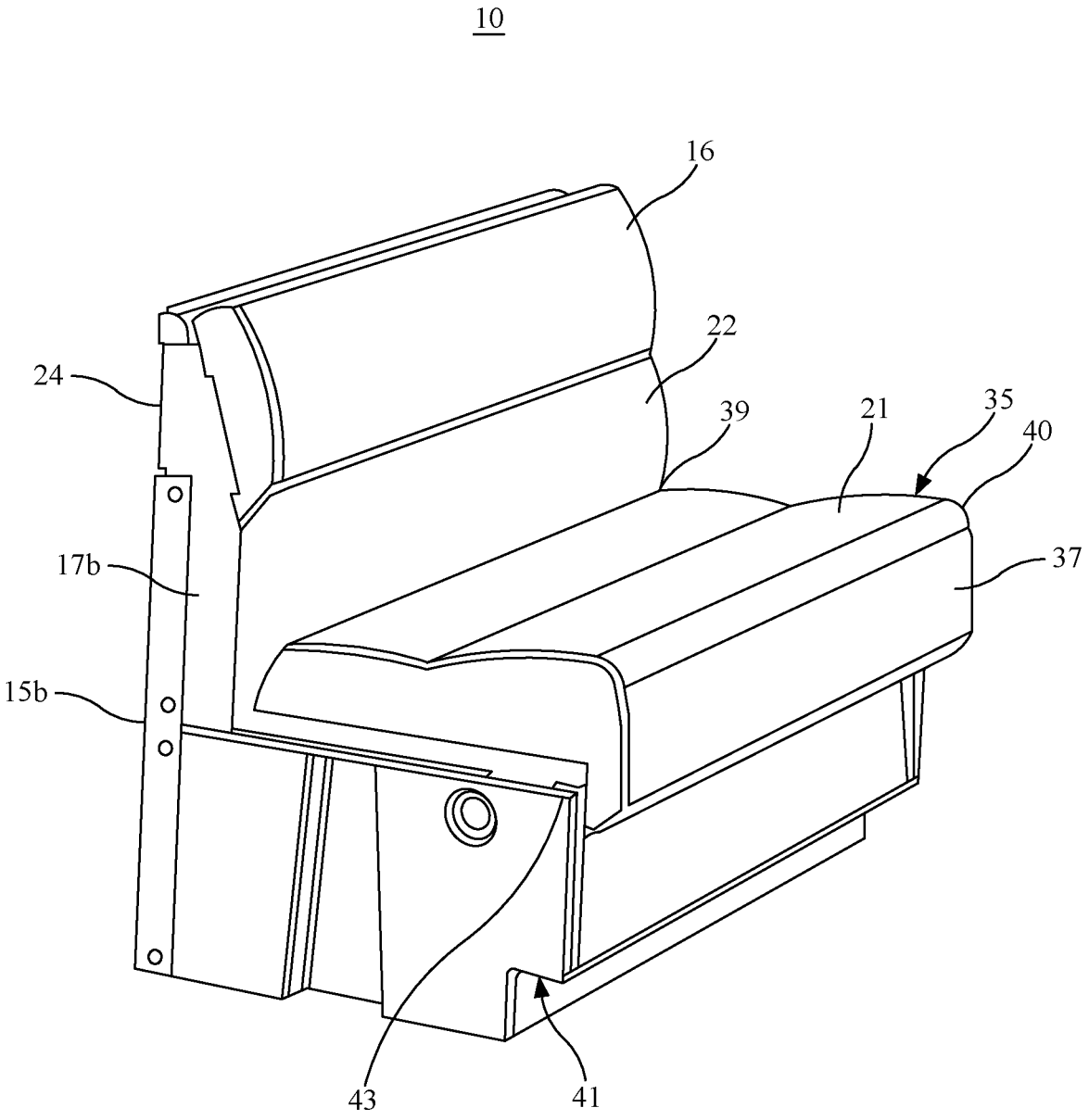
FIG. 3 is a schematic perspective view of the modular seating assembly of FIG. 1 in a closed position.

FIG. 1 is a schematic perspective view of a modular seating assembly 10 in an open position according to an embodiment of the present disclosure. FIG. 2 is a rear schematic exploded perspective view of the modular seating assembly 10 of FIG. 1. FIG. 3 is a schematic perspective view of the modular seating assembly 10 of FIG. 1 in a closed position.

The modular seating assembly 10 may include a top backrest portion 12, a seat support structure 15, and a bottom seating portion 18.

The top backrest portion 12 of the modular seating assembly 10 may include a backrest frame 14, a first backrest cushion 16 and a backrest gap 17. The backrest frame 14 may form a rear side of the backrest portion 12. The backrest frame 14 may be constructed from a rigid material such as, e.g., metal, a plastic, a composite, or the like. A front of the backrest portion 12 may include the first backrest cushion 16. As discussed later, the first backrest cushion 16 may function with a second backrest cushion as a user backrest. The second backrest cushion may be formed by a bolster flap 22 of a seat apex section 20 of the bottom seating portion 18. The first backrest cushion 16 may be fixedly attached to a front surface of backrest frame 17. The first backrest cushion 16 may include a pad having or being a filling made from a soft, foam, and/or cushioning material. The second backrest cushion may be formed from the bolster flap 22 of the bottom seating portion 18.

The backrest gap 17 may include a pair of arched structures 17*a* and 17*b* which may be positioned at each end of the backrest frame 14. Each arched structure 17*a* and 17*b* may be positioned at each end of the backrest frame 14. Each arched structure 17*a* and 17*b* may be positioned in a perpendicular direction relative to a corresponding end of the backrest frame 14 which may thereby create a gap (e.g., an aperture) in between the pair of arched structures 17*a* and 17*b*. The backrest gap 17 may be configured to receive the second backrest cushion (i.e., the bolster flap 22). The second backrest cushion may be detachably coupled to the backrest gap 17. The arched structures 17*a* and 17*b* may be constructed from a rigid material such as, e.g., metal, a plastic, a composite, or the like).

The seat support structure 15 may include a pair of angled structures (e.g., brackets) 15*a* and 15*b*, which each may connect to a rear portion of the backrest frame 14 and a seat base section 30 of the bottom seating portion 18. The pair of angled structures 15*a* and 15*b* may connect the top backrest portion 12 and the bottom seating portion 18 to one another thereby forming the modular seating assembly 10. The seat support structure 15 may be constructed of a rigid material such as, e.g., metal, a plastic, a composite, or the like. The seat support structure 15 may allow for the modular seating assembly 10 to be freestanding, which is in contrast to related art assemblies which typically rely on nearby structures, such as railings.

The bottom seating portion 18 of the modular seating assembly 10 may include a seat apex section 20, and a seat base section 30. In an embodiment, the bottom seating portion 18 may further include a pair of arm pivot attachments 28. The seat apex section 20 may rest on the seat base section 30 when the bottom seating portion 18 is in a closed position. The seat apex section 20 may be configured to rotate away from the seat base section 30 when the bottom seating portion 18 is in an open position. The seat apex section 20 may be configured to rotate away from the seat base section 30 via the pair of arm pivot attachments 28. The pair of arm pivot attachments 28 may couple the seat apex section 20 to the seat base section 30. In another embodiment, the seat apex section 20 may be configured to rotate away from the seat base section 30 via a hinge assembly.

Figure 4:
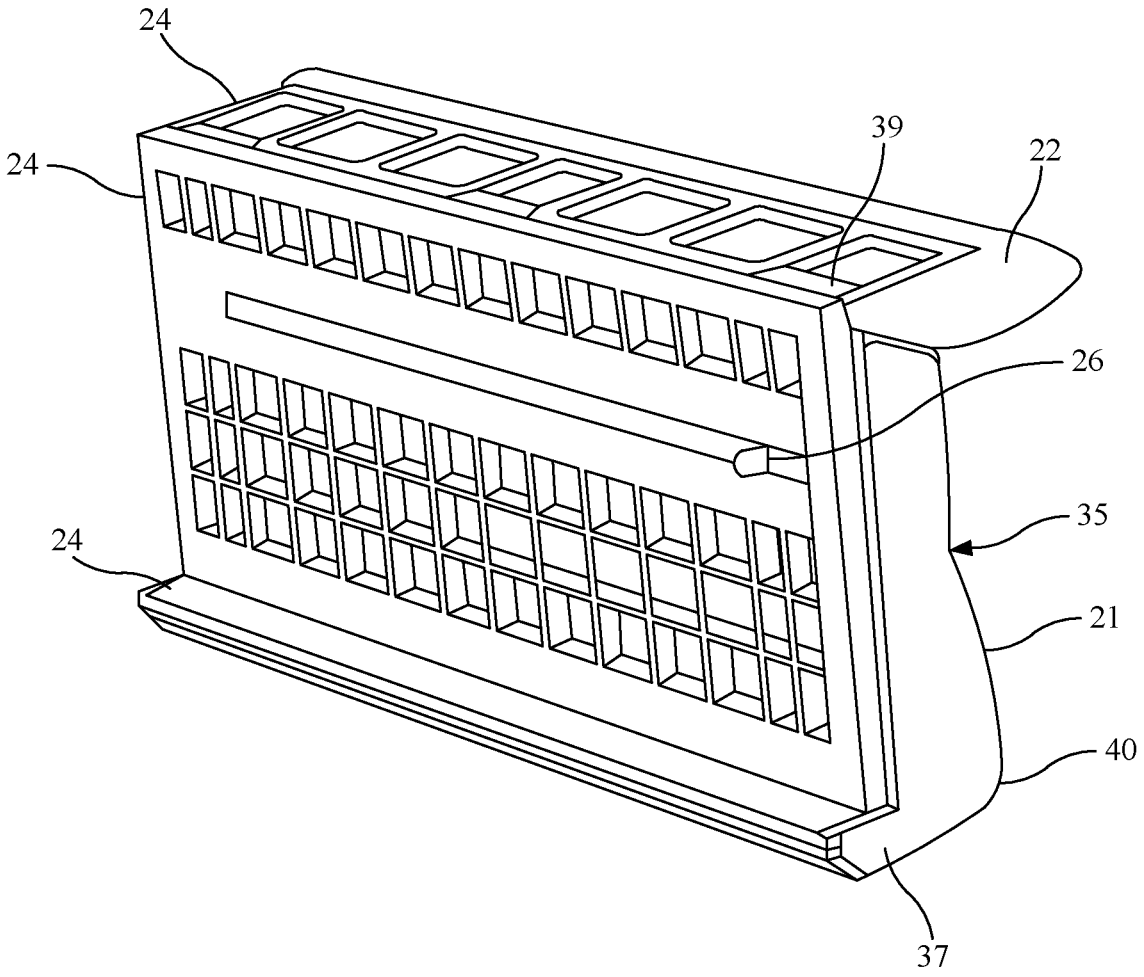
FIG. 4 is a schematic perspective view of a seat apex section of a modular seating assembly according to an embodiment of the present disclosure.
Figure 5:
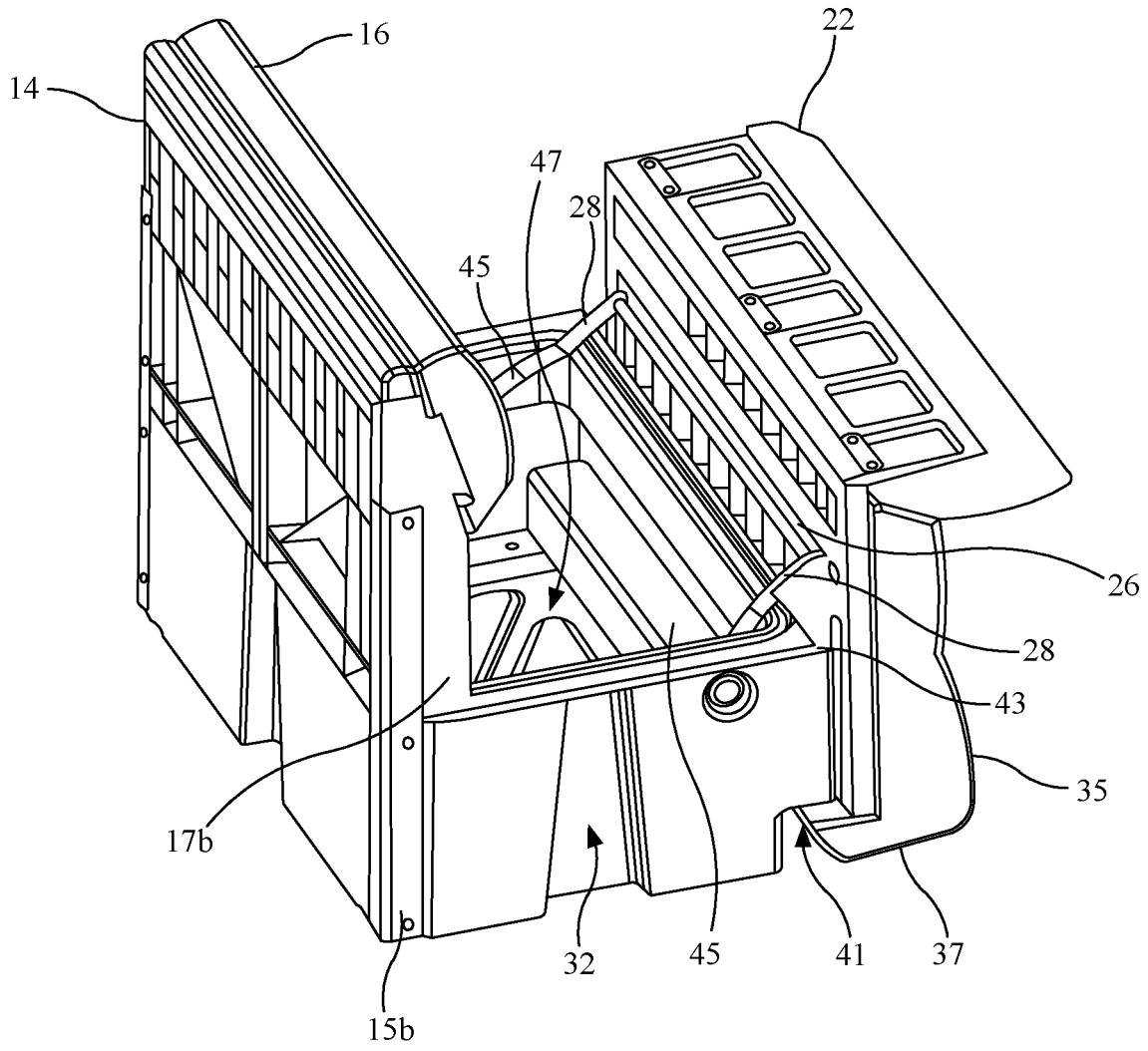
FIG. 5 is another schematic perspective view of the modular seating assembly of FIG. 1 in the open position.

FIG. 4 is a schematic perspective view of a seat apex section 20 of a modular seating assembly according to an embodiment of the present disclosure. FIG. 5 is another schematic perspective view of the modular seating assembly of FIG. 1 in the open position.

The seat apex section 20 may include a seat 35, a bolster flap 22, and an extension 37. The seat 35 may include seat cushion 21, a reinforcement structure 24, and a seat cushion support bar 26. The reinforcement structure 24 may be a frame attached to a rear (or bottom) side of seat cushion 21. The reinforcement structure 24 may be formed from a rigid material such as, e.g., metal, a plastic, a composite, or the like. The reinforcement structure 24 within the seat 35 may include a recess 23 for receiving the seat cushion support bar 26. The seat cushion support bar 26 may reinforce an area in which the seat cushion support bar 26 may be disposed when the bottom seating portion 18 is in the closed position. The seat cushion support bar 26 may be constructed from a rigid material such as, e.g., metal, a plastic, a composite, or the like. For example, the seat cushion support bar 26 may be a metal bar.

The bolster flap 22 may include a cushion portion and reinforcement structure. The reinforcement structure of the bolster flap 22 may not include a recess for receiving a seat cushion support bar. The bolster flap 22 may be rotatably coupled (e.g., hinged) to a rear side 39 of seat 35 and may be configured to fit into the backrest gap 17 when the bottom seating portion 18 is in the closed position, thereby forming the second backrest cushion of the top backrest portion 12. In an embodiment, the cushion portion of the bolster flap 22 may constitute the second backrest cushion of the top backrest portion when the bottom seating portion 18 is in the closed position. The bolster flap 22 may be detachably coupled to the backrest gap 17 of the top backrest portion 12 and may be retained therein by friction and/or gravity upon the seat apex section 20. The bolster flap 22 may be configured to detach from the backrest gap 17 when force is applied to the bolster flap 22 (e.g., the bolster flap 22 may be pulled from the backrest gap 17, thereby raising seat apex section 20 from the closed position to the open position). In another embodiment, the bolster flap 22 may include a handle to help facilitate (by pulling), the removal of the bolster flap 22 from the backrest gap 17.

The extension 37 may be integrated into (integral with) seat 35 at a front side 40 thereof and may be positioned perpendicular to the front side 40 of the seat 35 thereby creating a waterfall edge. The extension 37 may be configured to fit under a ledge region 41 of the seat base section 30 when the bottom seating portion 18 is in the open position, and may be configured to overlay a top perimeter region 43 of the seat base section 30 when the bottom seating portion 18 is in the closed position.

Each arm pivot attachment 28 may attach to opposite ends of the seat cushion support bar 26 at a first end, and may attach to opposite sides of an interior surface 45 of a seat base storage container 32 and a second end. The pair of arm pivot attachments 28 may be constructed as hinged arms. The seat apex section 20 may be rotatably connected to the seat base section 30 via the pair of arm pivot attachments 28. The pair of arm pivot attachments 28 may allow the seat apex section 20 to fold forward and downward as shown in FIGS. 1 and 5, when the bottom seating portion 18 is in the open position.

The seat base section 30 may include the seat base storage container 32 and a storage region 47 may be formed therein. Access to the storage region 47 may be provided when the bottom seating portion 18 is in the open position. The storage region 47 may be closed (access closed off) when the bottom seating portion 18 is in the closed position. As clear from the figures, access to the storage region 47 may be through, in part, the backrest gap 17 (in addition to through where seat apex section 20 would be disposed) thereby creating a larger opening (greater access) to the storage region 47 when compared with related art examples.

Figure 6:
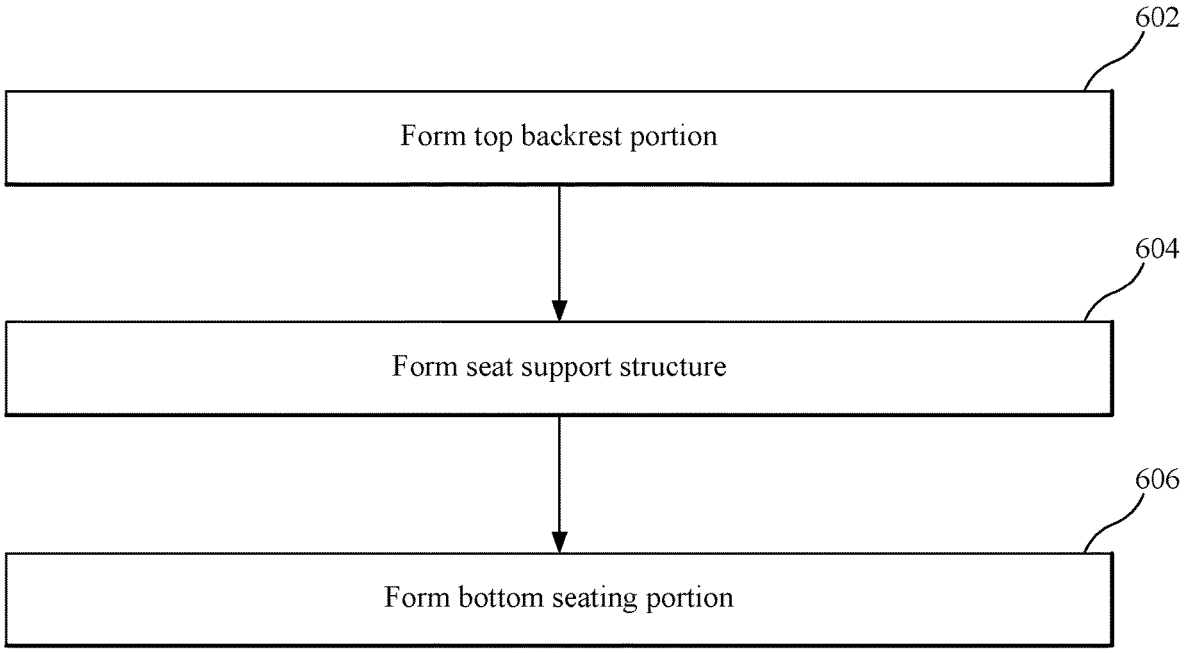
FIG. 6 is a flowchart schematically showing a method of manufacturing a modular seating assembly according to an embodiment of the disclosure.

FIG. 6 is a flowchart schematically showing a method 600 of manufacturing a modular seating assembly according to an embodiment of the disclosure. The method 600 may include forming a top backrest portion, forming a seat support structure, and forming a bottom seating portion.

The top backrest portion may be formed to include a backrest frame, a first backrest cushion, a backrest gap, and a second backrest cushion. The seat support structure may be formed to include a pair of supports connecting the top backrest portion and the bottom seating portion to one another to form the modular seating assembly. The bottom seating portion may be formed to include a seat apex section including the second backrest cushion, and a seat base section on which the seat apex section is disposed when the bottom seating portion is in a closed position.

The seat apex section may be configured to rotate away from the seat base section when the bottom seating portion is in an open position. The modular seating assembly may be formed to include a storage region formed within the bottom seating portion of the modular seating assembly.

The method 600 may include additional operations as may be necessary in manufacturing the embodiments herein. For example, the method 600 may include forming the seat apex section to include a seat and a bolster flap.

According to embodiments, a modular seating assembly and method of manufacturing the same may be provided. The embodiments provide advantages such as highly configurable seating installation (including freestanding installation), and larger access openings for storage access, which may be of particular utility with respect to pontoon boats. These and other advantages will be appreciated by one of ordinary skill in the art.

Embodiments of the disclosure are discussed above with reference to the figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present disclosure, recognize a multiplicity of alternate and suitable approaches, depending upon the needs of the particular application, to implement the functionality of any given detail described herein, beyond the particular implementation choices in the embodiments described and shown. That is, there are modifications and variations of the disclosure that are too numerous to be listed but that all fit within the scope of the disclosure.

What is claimed is:

1. A modular seating assembly, comprising:
a top backrest portion;
a seat support structure; and
a bottom seating portion, wherein
the top backrest portion includes:
a backrest frame;
a first backrest cushion; and
a backrest gap
the seat support structure includes:
a pair of supports connecting the top backrest portion and the bottom seating portion to one another to form the modular seating assembly,
the bottom seating portion includes:
a seat apex section including a second backrest cushion; and
a seat base section on which the seat apex section is disposed when the bottom seating portion is in a closed position,
the seat apex section is configured to rotate away from the seat base section when the bottom seating portion is in an open position,
the modular seating assembly includes a storage region formed within the bottom seating portion of the modular seating assembly,
the seat apex section includes:
a seat; and
a bolster flap constituted by the second backrest cushion. and the bolster flap is rotatably coupled to a rear side of the seat.

2. The modular seating assembly of claim 1, wherein the bolster flap further includes:
a reinforcement structure.

3. The modular seating assembly of claim 1, wherein the pair of supports include a pair of brackets.

4. The modular seating assembly of claim 3, wherein the pair of brackets are angled.

5. The modular seating assembly of claim 3, wherein the pair of brackets define an aperture in between the pair of brackets.

6. The modular seating assembly of claim 5, wherein each one of the pair of brackets is disposed in a perpendicular direction relative to a corresponding end of the backrest frame so as to define the aperture in between the pair of brackets.

7. The modular seating assembly of claim 5, wherein
the bolster flap includes a cushion portion constituting the second backrest cushion of the top backrest portion, and
the aperture is configured to receive the bolster flap.

8. The modular seating assembly of claim 7, wherein the seat apex section further includes an extension positioned perpendicular to a front side of the seat.

9. The modular seating assembly of claim 1, wherein the bottom seating portion further includes a pair of arm pivot attachments attached to the seat apex section.

10. The modular seating assembly of claim 9, wherein the pair of arm pivot attachments are further attached to the base section so that the seat apex section is configured to rotate away from the seat base section when the bottom seating portion is in the open position, and so that the seat apex section is configured to rotate toward to and rest upon the seat base section when the bottom seating portion is in the closed position.

11. A modular seating assembly, comprising:
a top backrest portion;
a seat support structure; and
a bottom seating portion, wherein
the top backrest portion includes:
a backrest frame;
a first backrest cushion; and
a backrest gap,
the seat support structure includes:
a pair of supports connecting the top backrest portion and the bottom seating portion to one another to form the modular seating assembly,
the bottom seating portion includes:
a seat apex section including:
a seat;
a bolster flap constituting a second backrest cushion; and
a seat base section on which the seat apex section is disposed when the bottom seating portion is in a closed position,
the seat apex section is configured to rotate away from the seat base section when the bottom seating portion is in an open position,
the modular seating assembly includes a storage region formed within the bottom seating portion of the modular seating assembly, and
the bolster flap is rotatably coupled to a rear side of the seat via a pair of brackets defining an aperture in between the pair of brackets.

12. A method of manufacturing a modular seating assembly, comprising:
forming a top backrest portion;
forming a seat support structure; and
forming a bottom seating portion, wherein
the top backrest portion is formed to include:
a backrest frame;
a first backrest cushion; and
a backrest gap the seat support structure is formed to include:

a pair of supports connecting the top backrest portion and the bottom seating portion to one another to form the modular seating assembly, the bottom seating portion is formed to include:

a seat apex section including a second backrest cushion; and a seat base section on which the seat apex section is disposed when the bottom seating portion is in a closed position, the seat apex section is configured to rotate away from the seat base section when the bottom seating portion is in an open position, the modular seating assembly is formed to include a storage region formed within the bottom seating portion of the modular seating assembly, the seat apex section includes:

a seat; and a bolster flap constituted by the second backrest cushion, and the bolster flap is rotatably coupled to a rear side of the seat.

13. The method of claim 12, wherein the bolster flap further includes:

a reinforcement structure.

14. The method of claim 12, wherein the pair of supports include a pair of brackets.

15. The method of claim 13, wherein the pair of brackets are angled.

16. The method of claim 13, wherein the pair of brackets define an aperture in between the pair of brackets.

17. The method of claim 16, wherein each one of the pair of brackets is disposed in a perpendicular direction relative to a corresponding end of the backrest frame so as to define the aperture in between the pair of brackets.

18. The method of claim 12, wherein the bottom seating portion further includes a pair of arm pivot attachments attached to the seat apex section.

19. The method of claim 18, wherein the pair of arm pivot attachments are further attached to the base section so that the seat apex section is configured to rotate away from the seat base section when the bottom seating portion is in the open position, and so that the seat apex section is configured to rotate toward to and rest upon the seat base section when the bottom seating portion is in the closed position.

* * * * *